US007435289B2

(12) United States Patent
Shears et al.

(10) Patent No.: US 7,435,289 B2
(45) Date of Patent: Oct. 14, 2008

(54) INTEGRATED AIR CLEANER AND VAPOR CONTAINMENT SYSTEM

(75) Inventors: Peter D. Shears, Wauwatosa, WI (US); John Gulke, Fond du Lac, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 377 days.

(21) Appl. No.: 11/236,253

(22) Filed: Sep. 27, 2005

(65) Prior Publication Data

US 2007/0068388 A1 Mar. 29, 2007

(51) Int. Cl.
*F02M 33/02* (2006.01)

(52) U.S. Cl. ..... 96/134; 96/137; 96/149; 123/519

(58) Field of Classification Search ..... 55/385.1, 55/385.3; 95/146; 96/134, 135, 136, 137, 96/147, 149; 123/518, 519, 520, 198 E
See application file for complete search history.

(56) References Cited

U.S. PATENT DOCUMENTS

| | | | |
|---|---|---|---|
| 1,499,864 | A | 7/1924 | Gordon |
| 2,358,840 | A | 9/1944 | Walker |
| 2,520,124 | A | 8/1950 | Chaney et al. |
| 2,553,763 | A | 5/1951 | Hammon |
| 2,822,059 | A | 2/1958 | Lunn et al. |
| 2,966,960 | A | 1/1961 | Rochin |
| 3,221,724 | A | 12/1965 | Wentworth |
| 3,352,294 | A | 11/1967 | Biller et al. |
| 3,368,326 | A | 2/1968 | Hervert |
| 3,372,679 | A | 3/1968 | Altken |
| 3,391,679 | A | 7/1968 | Williams et al. |
| 3,406,501 | A | 10/1968 | Watkins |
| 3,456,635 | A | 7/1969 | Hervert |
| 3,477,210 | A | 11/1969 | Hervert |
| 3,541,765 | A | 11/1970 | Adler et al. |
| 3,572,013 | A | 3/1971 | Hansen |
| 3,572,014 | A | 3/1971 | Hansen |
| 3,610,220 | A | 10/1971 | Yamada |
| 3,610,221 | A | 10/1971 | Stoltman |

(Continued)

FOREIGN PATENT DOCUMENTS

DE 4304180 8/1993

(Continued)

OTHER PUBLICATIONS

George A. Lavoie et al., "A Fuel Vapor Model (FVSMOD) for Evaporative Emissions System Design and Analysis," 1998 Society of Automotive Engineers, Inc.

(Continued)

*Primary Examiner*—Frank M Lawrence
(74) *Attorney, Agent, or Firm*—Michael Best & Friedrich LLP

(57) ABSTRACT

An air cleaner for an engine that includes a fuel tank and an air-fuel mixing device. The air cleaner includes a housing that defines an internal filter space and a canister at least partially formed as part of the housing. The canister is substantially non-permeable to fuel vapor. A first aperture provides fluid communication between the fuel tank and the canister and a second aperture provides fluid communication between the canister and the air-fuel mixing device.

26 Claims, 11 Drawing Sheets

U.S. PATENT DOCUMENTS 3,617,034 A 11/1971 Skinner
3,645,244 A 2/1972 Seyfarth
3,646,731 A 3/1972 Hansen
3,650,256 A 3/1972 Marshall
3,665,906 A 5/1972 De Palma
3,675,634 A 7/1972 Tatsutomi et al.
3,678,663 A 7/1972 Hansen
3,681,899 A 8/1972 Grote
3,696,799 A 10/1972 Gauck
3,721,072 A 3/1973 Clapham
3,747,303 A 7/1973 Jordan
3,757,753 A 9/1973 Hunt
3,759,234 A 9/1973 Buckton et al.
3,838,673 A * 10/1974 Csicsery et al. ..... 123/179.8
3,849,093 A 11/1974 Konishi et al.
3,913,545 A 10/1975 Haase et al.
3,926,168 A * 12/1975 Csicsery ..... 123/179.7
3,990,419 A 11/1976 Itakura
4,112,898 A 9/1978 Takimoto et al.
4,127,097 A 11/1978 Takimoto
4,175,526 A 11/1979 Phelan
4,259,096 A 3/1981 Nakamura et al.
4,261,717 A 4/1981 Belore et al.
4,279,233 A 7/1981 Tobita et al.
4,279,630 A 7/1981 Nakamura et al.
4,280,360 A 7/1981 Kobayashi et al.
4,375,204 A 3/1983 Yamamoto
4,415,344 A 11/1983 Frost et al.
4,418,662 A 12/1983 Engler et al.
4,446,838 A 5/1984 Suzuki et al.
4,475,522 A 10/1984 Oonaka
4,629,479 A 12/1986 Cantoni
4,631,077 A 12/1986 Spicer et al.
4,631,952 A 12/1986 Donaghey
4,658,795 A 4/1987 Kawashima et al.
4,684,382 A 8/1987 Abu-Isa
4,684,510 A 8/1987 Harkins
4,705,007 A 11/1987 Plapp et al.
4,747,388 A 5/1988 Tuckey
4,758,460 A 7/1988 Spicer et al.
4,766,872 A * 8/1988 Kato et al. ..... 123/519
4,852,761 A 8/1989 Turner et al.
4,919,103 A 4/1990 Ishiguro et al.
4,938,787 A 7/1990 Simmerlein-Erlbacher
5,215,132 A 6/1993 Kobayashi
5,221,573 A 6/1993 Baigas, Jr.
5,226,397 A 7/1993 Zabeck et al.
5,259,412 A 11/1993 Scott et al.
5,261,439 A 11/1993 Harris
5,301,829 A 4/1994 Chrisco
5,313,977 A 5/1994 Bergsma et al.
5,313,978 A 5/1994 Takaki et al.
5,326,514 A 7/1994 Linden et al.
5,338,253 A 8/1994 Damsohn et al.
5,350,444 A 9/1994 Gould et al.
5,408,977 A 4/1995 Cotton
5,424,036 A 6/1995 Ushikubo
5,437,701 A 8/1995 Townsley
5,453,118 A 9/1995 Heiligman
5,478,379 A 12/1995 Bevins
5,560,345 A 10/1996 Geyer et al.
5,562,084 A 10/1996 Shimamura
5,566,705 A 10/1996 Harris
5,573,811 A 11/1996 Townsley
5,623,911 A 4/1997 Kiyomiya et al.
5,638,786 A 6/1997 Gimby
5,704,337 A 1/1998 Stratz et al.
5,727,531 A 3/1998 Osanai
5,762,692 A 6/1998 Dumas et al.
5,798,270 A 8/1998 Adamczyk, Jr. et al.
5,809,976 A 9/1998 Cook et al.
5,871,569 A 2/1999 Oehler et al.
5,875,768 A 3/1999 Schenk et al.
5,878,729 A 3/1999 Covert et al.
5,891,207 A 4/1999 Katta
5,898,107 A 4/1999 Schenk
5,901,689 A 5/1999 Kimura et al.
5,912,368 A 6/1999 Satarino et al.
5,935,398 A 8/1999 Taniguchi et al.
5,957,114 A 9/1999 Johnson et al.
6,102,085 A 8/2000 Nanaji
6,105,708 A 8/2000 Amano et al.
6,136,075 A 10/2000 Bragg et al.
6,152,996 A 11/2000 Linnersten et al.
6,156,089 A 12/2000 Stemmer et al.
6,182,693 B1 2/2001 Stack et al.
6,189,516 B1 2/2001 Hei Ma
6,231,646 B1 5/2001 Schweizer et al.
6,237,574 B1 5/2001 Jamrog et al.
6,269,802 B1 8/2001 Denis et al.
6,273,070 B1 8/2001 Arnal et al.
6,302,144 B1 10/2001 Graham et al.
6,330,879 B1 12/2001 Kitamura et al.
6,354,280 B1 3/2002 Itakura et al.
6,367,458 B1 4/2002 Furusho et al.
6,390,074 B1 5/2002 Rothamel et al.
6,395,048 B1 5/2002 Yoder et al.
6,463,915 B2 10/2002 Ozaki et al.
6,464,761 B1 10/2002 Bugli
6,505,610 B2 1/2003 Everingham et al.
6,591,866 B2 7/2003 Distelhoff et al.
6,595,167 B2 7/2003 Kaesgen
6,675,780 B1 1/2004 Wendels et al.
6,692,551 B2 2/2004 Wernholm et al.
6,692,555 B2 2/2004 Oda et al.
6,699,310 B2 3/2004 Oda et al.
6,729,312 B2 5/2004 Furushou
6,729,319 B2 5/2004 Mitsutani
6,736,871 B1 5/2004 Green et al.
6,758,885 B2 7/2004 Leffel et al.
6,772,740 B2 8/2004 Kojima et al.
6,779,512 B2 8/2004 Mitsutani
6,786,207 B2 9/2004 Kojima et al.
6,863,082 B1 2/2005 McIntosh et al.
6,874,484 B2 4/2005 Benjey
6,874,485 B2 4/2005 Fujimoto
6,877,488 B2 4/2005 Washeleski et al.
6,892,711 B2 5/2005 Belanger, Jr. et al.
6,959,696 B2 11/2005 Shears et al.
6,976,477 B2 12/2005 Gimby et al.
7,267,112 B2 * 9/2007 Donahue et al. ..... 123/518
2005/0005917 A1 1/2005 Veinotte
2005/0178368 A1 8/2005 Donahue et al.
2005/0284450 A1 12/2005 Mills

FOREIGN PATENT DOCUMENTS

EP 0 611896 8/1994
EP 1110593 6/2001
GB 2082935 3/1992
JP 54141916 11/1979
JP 58-067960 4/1983

OTHER PUBLICATIONS

H. Bauer.-ed., "Gasoline-Engine Management," 1999, p. 152, Robert Bosch GmbH.
H. Bauer.-ed., "Gasoline Engine Management," 1999, p. 288-289, Robert Bosch GmbH.
H. Bauer.-ed., "Gasoline Engine Management," 1999, pp. 343-345, Robert Bosch GmbH.
"Automotive Fuel Lines," Verlag Moderne Industie, 1998, p. 4.

* cited by examiner

INTEGRATED AIR CLEANER AND VAPOR CONTAINMENT SYSTEM

BACKGROUND

The present invention relates to a vapor containment system for an engine, and particularly to an engine vapor containment system that is at least partially formed as part of an air cleaner.

Internal combustion engines are often used to power outdoor power equipment such as lawnmowers, tillers, snow throwers, and the like. Typically, these engines include a fuel system that supplies fuel for combustion. The fuel system includes a tank, in which fuel is stored for use. Generally, the volatility of the fuel allows a portion of the fuel to evaporate and mix with air within the tank. Changes in temperature, such as those between evening and daytime, as well as sloshing during use can cause an increase or a decrease in the amount of fuel vapor in the tank as well as an increase or a decrease in the pressure within the tank. In addition, the pressure within the fuel tank typically drops as fuel is drawn from the tank during engine operation.

To accommodate these pressure changes, fuel tanks often include a vent such as a vented fuel cap. The vent allows the excess air and fuel vapor to escape from the tank when the pressure increases, and also allows air to enter the tank when the pressure drops. However, the escape of fuel vapor reduces the fuel efficiency of the engine.

SUMMARY

The invention provides an air cleaner for an engine that includes a fuel tank and an air-fuel mixing device. The air cleaner includes a housing that defines an internal filter space and a canister at least partially formed as part of the housing. The canister is substantially non-permeable to fuel vapor. A first aperture provides fluid communication between the fuel tank and the canister and a second aperture provides fluid communication between the canister and the air-fuel mixing device.

The invention also provides an air cleaner for an engine that includes a fuel tank and an air-fuel mixing device. The air cleaner includes a housing adapted to attach to the engine and a filter element supported by the housing and positioned to define a clean air space. A canister is positioned substantially within the housing and includes an aperture that provides fluid communication between the clean air space and the canister. A first passageway aperture provides fluid communication between the canister and the air-fuel mixing device and a second passageway aperture provides fluid communication between the canister and the fuel tank.

The invention also provides an engine that includes a combustion chamber that is operable to combust an air-fuel mixture and an air-fuel mixing device operable to deliver the air-fuel mixture to the combustion chamber. The engine also includes a fuel tank, an air cleaner including a housing that defines a clean air space, and a canister at least partially formed as part of the housing and including an aperture that provides fluid communication between the canister and the clean air space. A first passageway provides fluid communication between the canister and the air-fuel mixing device and a second passageway provides fluid communication between the canister and the fuel tank.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
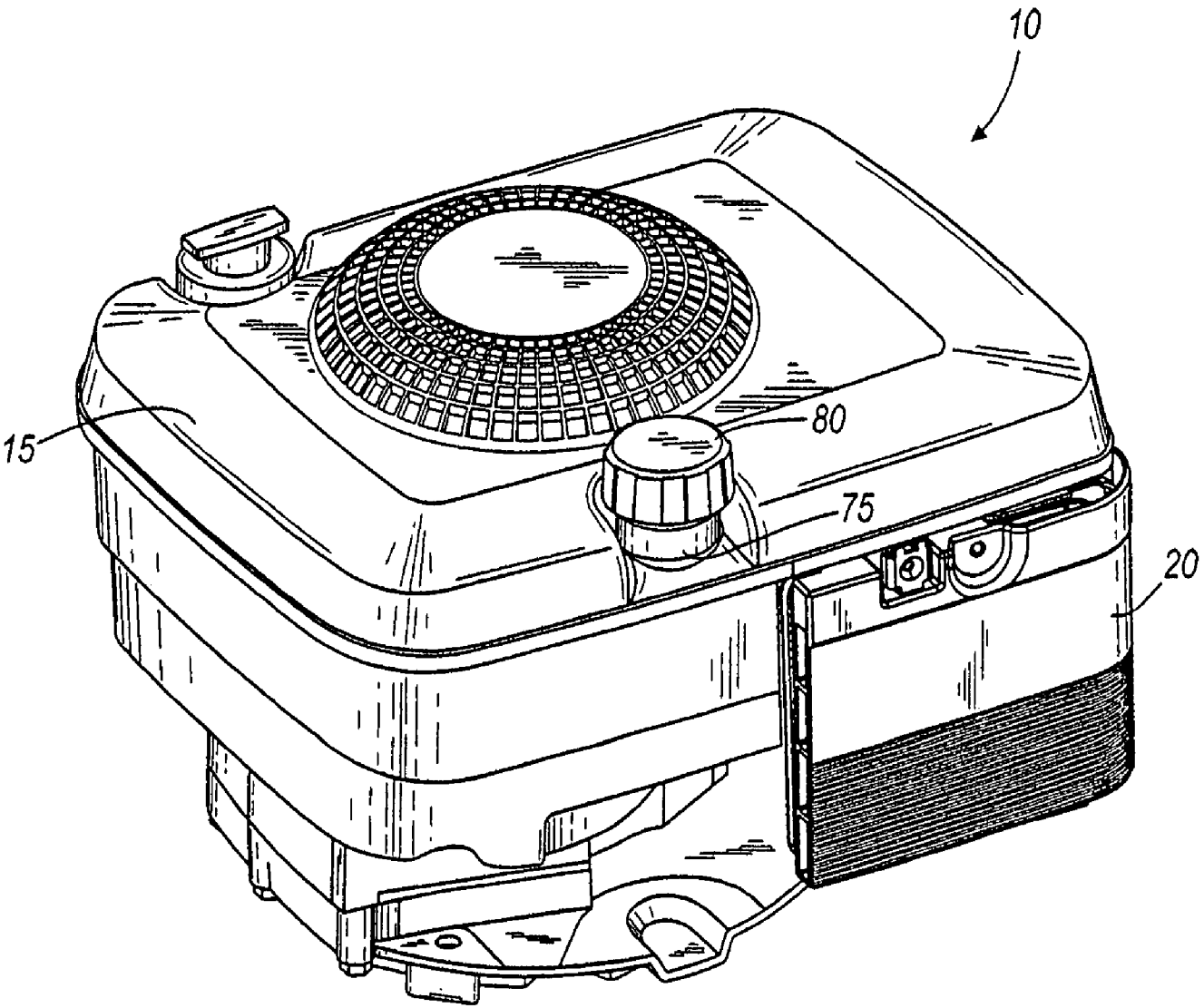
FIG. 1 is a perspective view of an engine including an air cleaner having a vapor containment system.

With reference to FIG. 1, an engine 10 including a fuel tank 15, an air cleaner assembly 20, and an air-fuel mixing device 25 that may include a carburetor 30 (shown in FIG. 2) is illustrated. Engines 10 of this type are often used to power outdoor power equipment such as lawnmowers, garden tractors, snow throwers, tillers, pressure washers, generators, and the like. While the illustrated engine 10 is a small engine (e.g., two or fewer cylinders), it should be understood that the invention will function with other types of engines including large internal combustion engines.

The air cleaner assembly 20 is positioned near an outer surface of the engine 10 such that air can be drawn from the atmosphere into the air cleaner assembly 20. The air cleaner assembly 20 filters particulate matter (e.g., dirt, pollen, debris, and the like) from the air and delivers the clean air to an air-fuel mixing device such as a carburetor 30. The carburetor 30 could be a float carburetor, a diaphragm carburetor or any other type of carburetor. As is known in the art, the carburetor 30, shown in FIG. 2, includes a throttle plate 35 (shown schematically in FIGS. 6-9) that controls the quantity of air that passes through the carburetor 30. The carburetor 30 also includes a throat 40 that defines a venturi. As the air passes through the throat 40, the venturi draws fuel from a fuel bowl 45 into the air stream and mixes the fuel and air to produce a combustible air-fuel mixture. The carburetor 30 delivers the air-fuel mixture to a combustion chamber 50 where the mixture is combusted to produce usable power. For purposes of this description, the entire air-fuel flow path between and including the carburetor 30 and the inlet to the combustion chamber 50 is considered to be part of the air-fuel mixing device 25. Alternatively, the air-fuel mixing device could include a throttle body, one or more fuel injectors, and/or an intake manifold.

The engine 10 includes one or more pistons 55 (shown schematically in FIGS. 6-9) that reciprocate within one or more cylinders 60 to define one or more combustion chambers 50. The illustrated engine 10 includes a single piston 55 that reciprocates within a single cylinder 60 to define a single combustion chamber 50. A spark ignites the air-fuel mixture within the combustion chamber 50 to produce useable shaft power at a crankshaft. Other types of engines (e.g., rotary engines, diesel engines, etc.) may define the combustion chamber in a different manner, or may ignite the air-fuel mixture in a different manner to produce the useable power.

Figure 2:
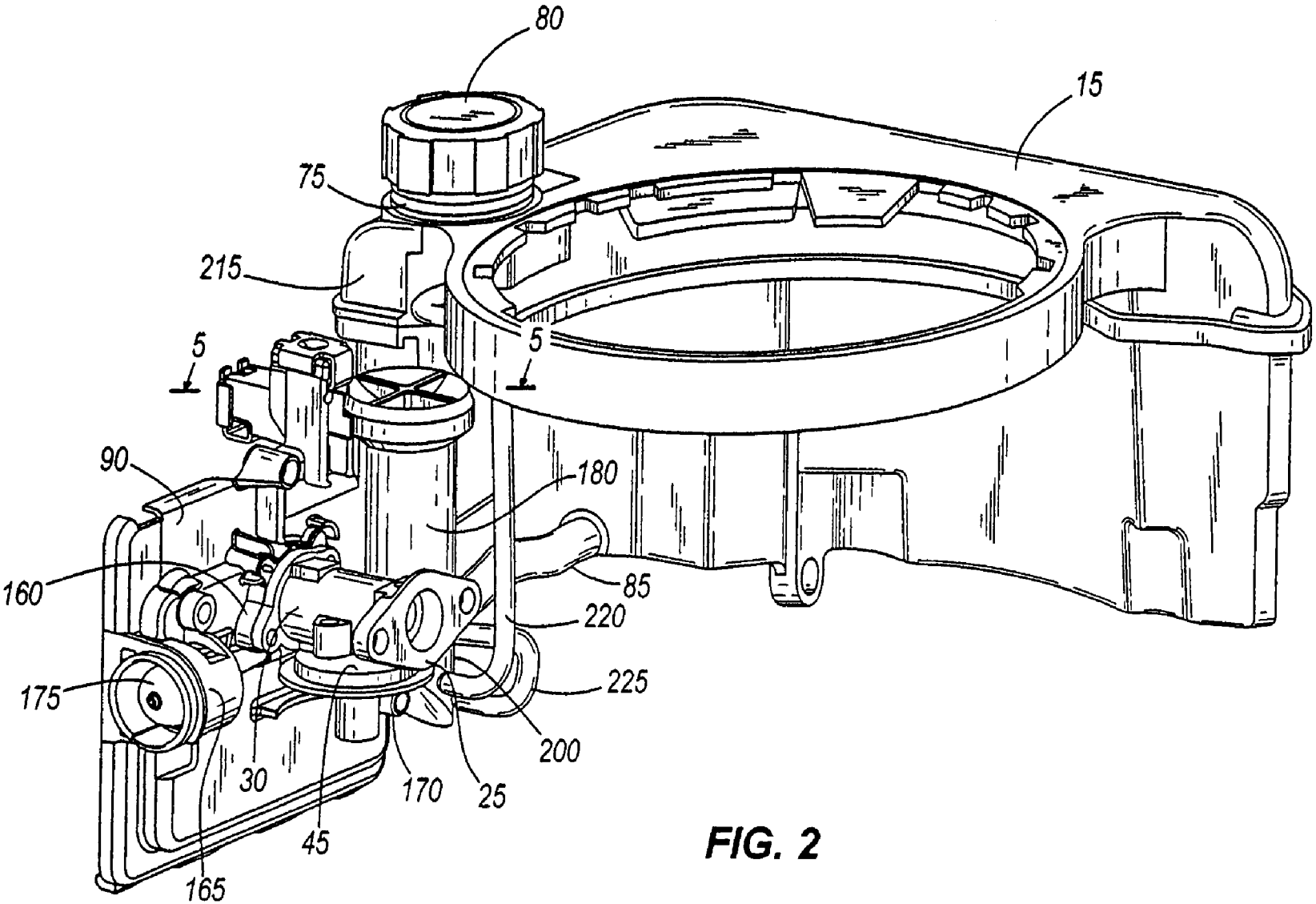
FIG. 2 is a perspective view a the fuel tank, a carburetor, and the air cleaner of FIG. 1.

The fuel tank 15, illustrated in FIGS. 1 and 2, is formed to fit around the outer portion of the engine 10 and to define an internal space 65 suitable for storing liquid fuel 70. The tank 15 includes a fill spout 75 formed in the top of the tank 15 and a cap 80 that threadably engages the fill spout 75 to substantially seal the tank 15. A fuel line 85 extends from a bottom portion of the tank 15 to the fuel bowl 45 of the carburetor 30. The position of the fuel bowl 45, below the fuel tank 15, allows gravity alone to deliver a flow of fuel from the fuel tank 15 to the fuel bowl 45. Other engines 10 may include a fuel pump or other device that aids in moving the fuel from the tank 15 to the carburetor 30 or other air-fuel mixing device 25.

Figure 3:
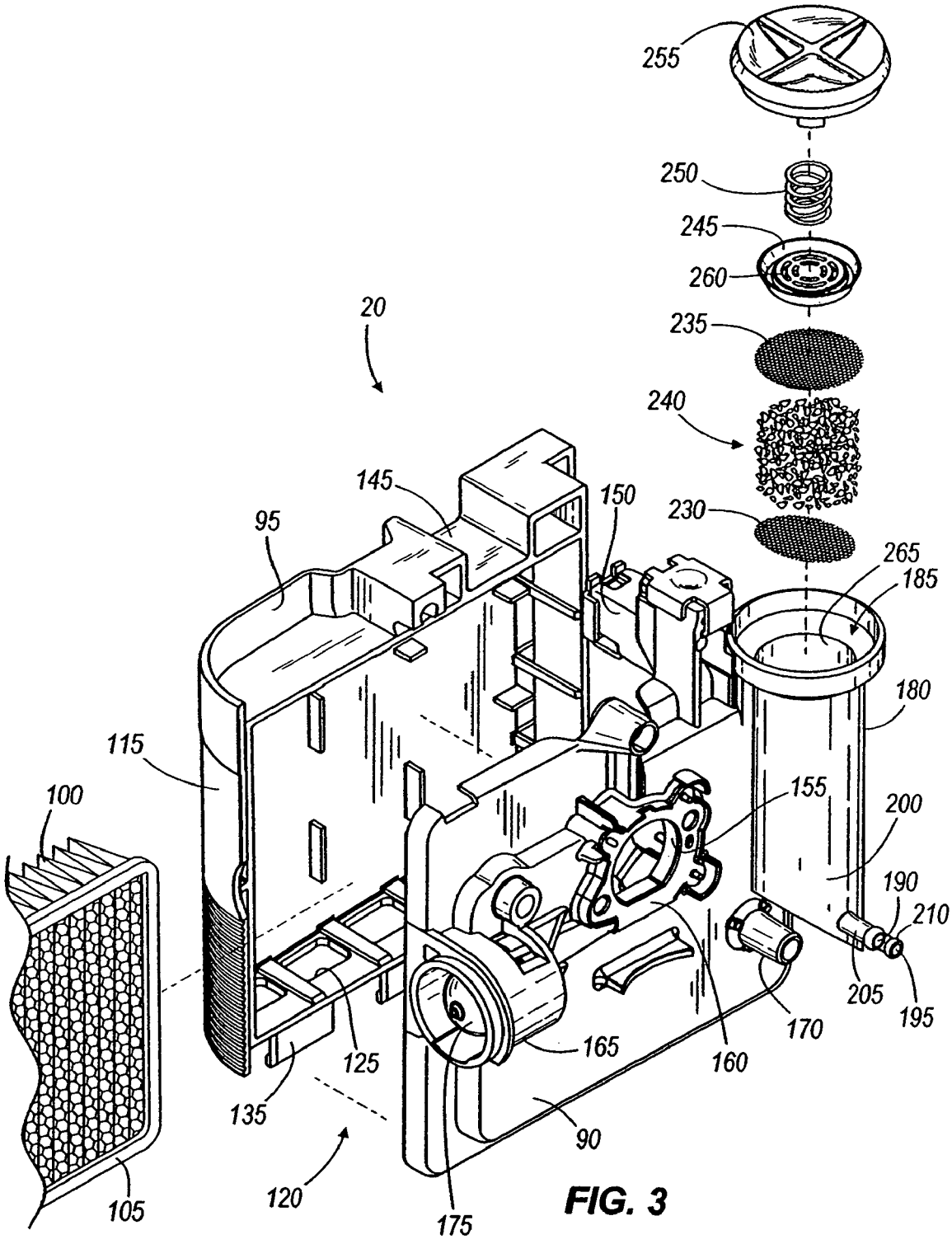
FIG. 3 is an exploded perspective view of the air cleaner of FIG. 1.

Turning to FIG. 3, the air cleaner assembly 20 is shown in an exploded view to better illustrate the various components. The air cleaner assembly 20 includes a back plate 90, a cover 95, and a filter element 100 disposed between the back plate 90 and the cover 95. Generally, a pleated paper filter element 100 is employed, with other types of filter elements also being suitable for use. In preferred constructions, the filter element 100 includes a perimeter portion 105 made from a resilient material such as urethane foam. The perimeter portion 105 abuts against one of, or both of the back plate 90 and the cover 95 to form a substantially air tight seal. Thus, the filter element 100 separates the atmosphere from a clean air space 110 disposed substantially between the filter element 100 and the back plate 90.

The cover 95 includes an outer surface 115 that is generally exposed when the engine 10 is assembled. The cover 95 engages the back plate 90 to define a filter space 120 and to substantially enclose and protect the filter element 100. One or more apertures 125 are formed in the cover 95 to allow for the passage of air from the atmosphere into the air cleaner assembly 20. The apertures 125 are arranged to direct the incoming air to a dirty side 130 of the filter element.

The cover 95 also includes several tabs 135 that extend downward from the cover 95. The tabs 135 engage slots (not shown) that are formed in the back plate 90 to couple the cover 95 to the back plate 90. A clamp space 145 formed at the top of the cover 95, opposite the tabs 135, engages a clamp 150 positioned on the back plate 90 to hold the cover 95 in the closed or assembled position. The clamp 150 is releasable to allow for the removal, cleaning, and replacement of the filter element 100 as needed. As one of ordinary skill in the art will realize, many different ways of attaching the cover 95 to the back plate 90 are possible. For example, fasteners, such as screws, could be employed to attach the cover 95 to the back plate 90. As such, the invention should not be limited to the arrangement illustrated and described herein.

The back plate 90 attaches to the engine 10 and supports the remaining components of the filter assembly 20. The back plate 90 cooperates with the filter element 100 to substantially enclose the clean air space 110. A large aperture 155 is formed in the back plate 90 and is surrounded by a mounting flange 160. As illustrated in FIG. 2, the carburetor 30 attaches directly to the mounting flange 160 such that clean air can pass from the clean air space 110, through the aperture 155, and directly into the carburetor 30. Other constructions may employ a tube or other flow element disposed between the back plate 90 and the carburetor 30 to direct the air to the carburetor 30.

With reference to FIG. 3, the back plate 90 also includes a primer housing 165 at least partially formed as part of the back plate 90, and a breather inlet 170 that extends from the back plate 90. The breather inlet 170 receives a flow of fluid from a crankcase and/or rocker box breather. Generally, this fluid contains some lubricant that is preferably returned to the crankcase when possible. When not possible, the breather inlet 170 illustrated in FIG. 3 directs the flow of fluid into the clean air space 110 of the filter assembly 20. From the clean air space, the fluid can be combusted by the engine 10, rather than being discharged to the atmosphere.

The primer housing 165 supports the components of a primer 175 and at least partially defines a fluid flow path between the primer 175 and the carburetor 30. The primer 175 is used to draw fuel from the fuel tank 15 to the carburetor 30 to aid in starting the engine 10.

With continued reference to FIG. 3, a canister 180 is at least partially formed as part of the back plate 90 of the filter assembly 20. The canister 180 includes walls that are substantially non-permeable to fluids such as air, water, fuel, oil, hydrocarbons, and the like. The canister 180 defines an interior space 185 that is substantially separate from the filter space 120. The canister 180 includes two apertures 190, 195 positioned near a lower end 200 of the canister 180. Flow connectors 205, 210 extend around the apertures 190, 195 and away from the canister 180 to provide connection points for flow devices such as pipes or tubes. The first aperture 190 provides fluid communication between the fuel tank 15 and the interior space 185 of the canister 180. More specifically, the first aperture 190 provides fluid communication between a top portion 215 of the fuel tank 15 and the interior space 185 of the canister 180. Thus, a first flow path 220 extends between the top portion 215 of the fuel tank 15 and the first aperture 190. The second aperture 195 provides fluid communication between the air-fuel mixing device 25 and the interior space 185 of the canister 180. In the illustrated construction, a second flow path 225 is at least partially defined by a tube that extends from the second flow connector 210 to the air-fuel mixing device 25 in the flow path between the carburetor 30 and the combustion chamber 50. In other constructions, the tube extends directly into the carburetor 30 or the combustion chamber 50, rather than into the flow path between the carburetor 30 and the combustion chamber 50.

As shown in FIG. 3, the interior space 185 of the canister 180 contains and supports a lower filter element 230, an upper filter element 235, a filter media 240, a piston 245, a spring 250, and a cover 255. In preferred constructions, the filter media 240 adsorbs hydrocarbons, such as fuel vapor, that may be entrained in the fluid that passes through the canister 180. One suitable filter media 240 is activated charcoal, with other types of filter media 240 also being suitable for use.

The lower filter element 230 is positioned within the canister 180 and provides support for the filter media 240. In preferred constructions, the lower filter element 230 is rigid enough to support the filter media 240 and permeable enough to allow for the passage of fluid without allowing the passage of the filter media 240. In one construction, a metallic screen is employed. The screen includes openings that are large enough to allow for the passage of fluid but small enough to inhibit passage of the filter media 240. The upper filter element 235 is substantially the same as the lower filter element 230. Thus, the upper filter element 235 and the lower filter element 230 sandwich and support the filter media 240.

The piston 245 rests on top of the upper filter element 235 and is movable within the interior space 185 of the canister 180. Several openings 260 are formed in the piston 245 to allow for the relatively free flow of fluid past the piston 245. The cover 255 engages the top portion of the canister 180 to substantially enclose the interior space 185. In some constructions the cover 255 is welded to the canister 180, thus making the closure permanent. In other constructions, other closure means such as threads are employed. Constructions that employ threads allow for the removal and replacement of the components disposed within the canister 180. The spring 250 is positioned between the piston 245 and the cover 255 to bias the piston 245 in a downward direction to compress the filter media 240 between the upper filter element 235 and the lower filter element 230. Alternatively, the spring 250 and piston 245 may be replaced with other means of supplying compressive force. For example, other constructions employ urethane or polyester foams in place of the spring 250 and piston 245.

Figure 4:
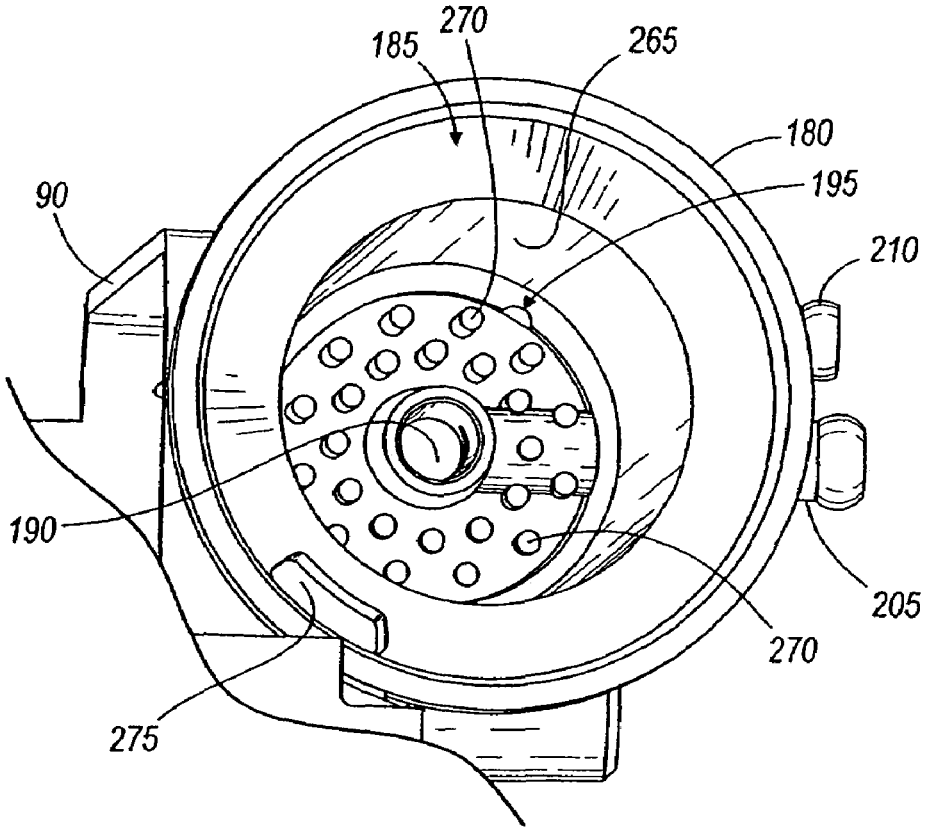
FIG. 4 is an enlarged perspective view of a portion of the air cleaner of FIG. 1.

FIG. 4 illustrates the bottom of the interior space 185 of the canister 180. The first aperture 190 extends into the center of the canister 180, while the second aperture 195 terminates at an interior wall 265 of the canister 180. A number of standoffs 270 extend from the bottom of the canister 180 and provide support for the lower filter element 230. Thus, a substantially empty space is defined beneath the filter media 240 and between the first aperture 190 and the second aperture 195.

Figure 5:
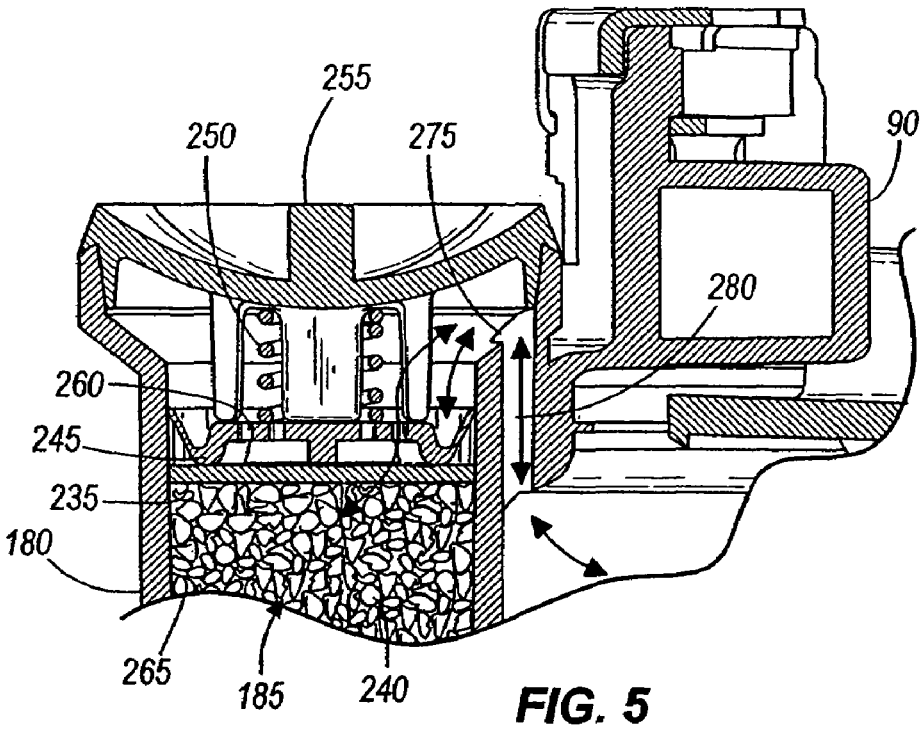
FIG. 5 is a section view of the air cleaner of FIG. 1, taken along line 5-5 of FIG. 2.

Another opening 275, shown in FIG. 4 is formed in the top portion of the canister 180 to provide fluid communication between the top portion of the canister 180 and the clean air space 110 of the filter assembly 20. FIG. 5 illustrates a filtered air flow path 280 that is at least partially formed as part of the back plate 90 and that extends from the opening 275 into the clean air space 110.

There are generally four different operating conditions that can occur within a typical engine 10. The invention described herein contains fuel vapor within the engine 10 and combusts the fuel vapor where possible under all four operating conditions.

Figure 6:
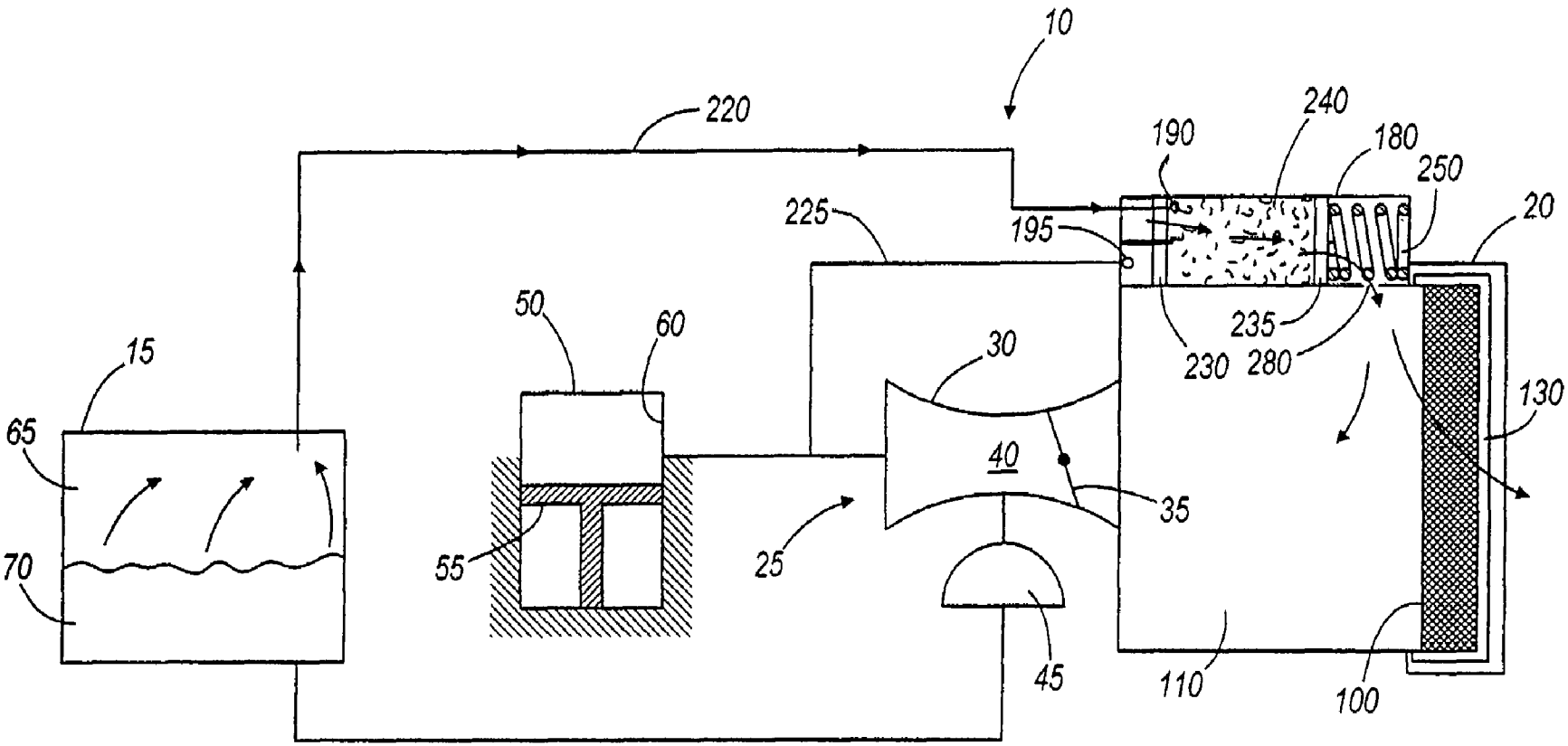
FIG. 6 is a schematic illustration of the vapor containment system during a pressure rise within the fuel tank when the engine is idle.

The first operating condition, illustrated in FIG. 6, occurs when the pressure within the fuel tank 15 increases above atmospheric pressure but the engine 10 is not running. This condition frequently occurs when the engine 10 is stored in an area subjected to temperature changes during the day. During a period of increasing temperature, the temperature of the fuel 70 and the fuel tank 15 also increase. The increased temperature within the fuel tank 15 increases the pressure and increases the amount of fuel vapor mixed with the air within the fuel tank 15. The increased pressure within the tank 15 forces some of the air-fuel mixture within the tank 15 to flow along the first flow path 220 to the first aperture 190 of the canister 180. The flow enters the canister 180 and flows through the lower filter element 230, the filter media 240, the upper filter element 235, the piston 245, and through the filtered air path 280 to the clean air space 110 of the filter assembly 20. As the air-fuel mixture passes through the canister 180, at least some of the fuel vapor is adsorbed by the filter media 240 such that the flow exiting the canister 180 contains a reduced quantity of fuel vapor. The adsorbed fuel vapor is trapped within the filter media 240. The filtered air is free to flow from the clean air space 110 out of the filter assembly 20 through the filter element 100.

Figure 7:
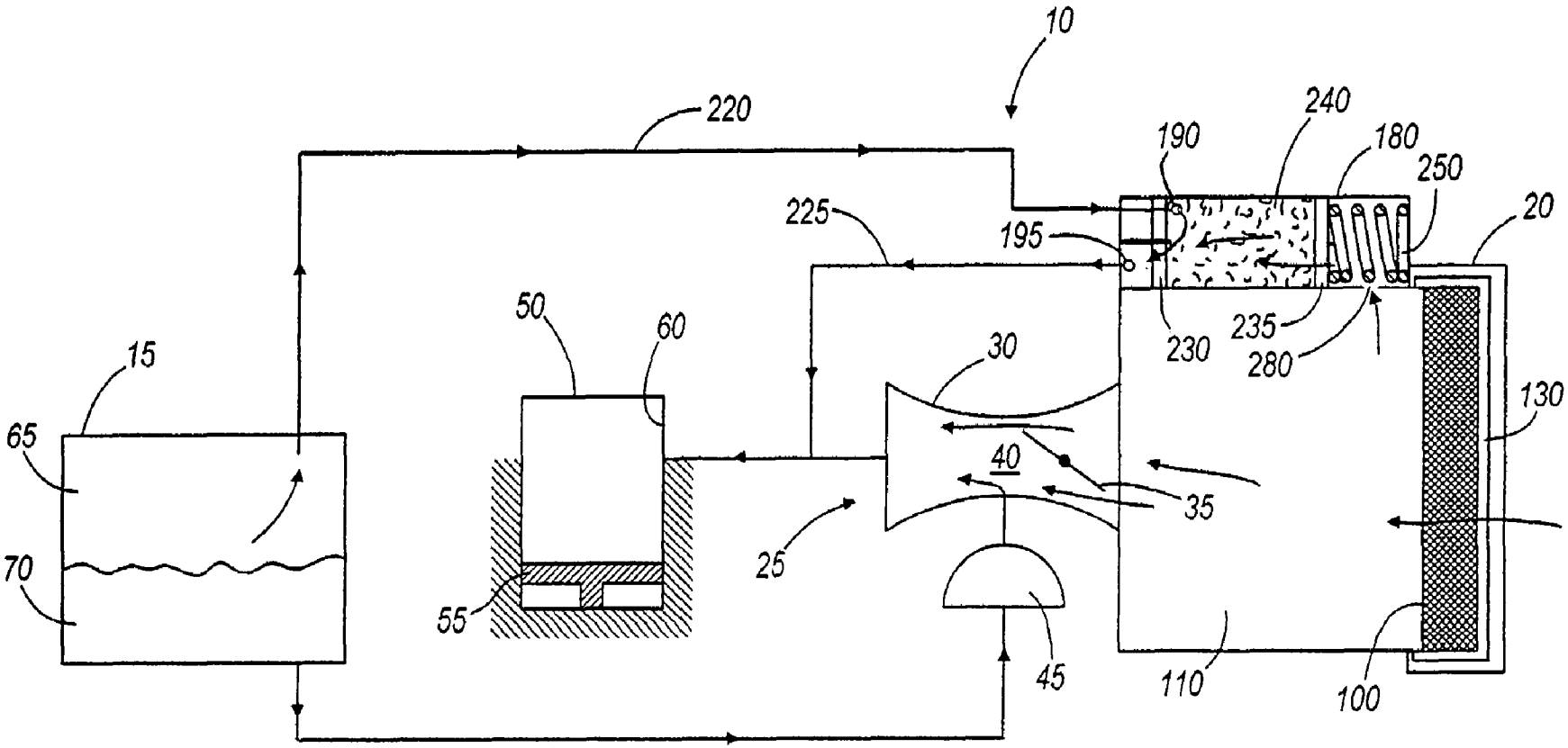
FIG. 7 is a schematic illustration of the vapor containment system during a pressure rise within the fuel tank when the engine is running.

FIG. 7 illustrates the various flows within the engine 10 when the pressure within the fuel tank 15 has increased above atmospheric pressure and the engine 10 is running. During this operating condition, the pressure within the tank 15 forces some of the air-fuel mixture within the fuel tank 15 to flow along the first flow path 220 to the canister 180. Liquid fuel 70 flows within the fuel line 85 to the fuel bowl 45 of the carburetor 30. Operation of the engine 10 draws unfiltered air into the air cleaner assembly 20 and through the filter element 100 where the air is filtered. The filtered air passes through the carburetor 30 and through the throat 40 of the carburetor 30. As the air passes through the throat 40, the venturi draws fuel into the air stream and mixes the fuel and the air to produce a combustible air-fuel mixture. The air-fuel mixture from the fuel tank 15 enters the canister 180 as was described with regard to FIG. 6. However, rather than passing through the filter media 240 within the canister 180, the air-fuel mixture passes through the second aperture 195 in the canister 180 and flows along the second flow path 225 to the air-fuel mixing device 25. Specifically, the flow enters the air-fuel mixing device 25 downstream of the back plate 90 and upstream of the combustion chamber 50. Thus, when the engine 10 is operating, excess fuel vapor from the fuel tank 15 is combusted in the engine 10, rather than vented to the atmosphere. Additionally, air passes through the aperture 280, through the filter media 240, and out of the canister 180 through the aperture 195 joining the vapor rich air from the fuel tank 15. This flow of air purges or desorbs vapors from the filter media 240 to restore adsorptive capacity.

Figure 8:
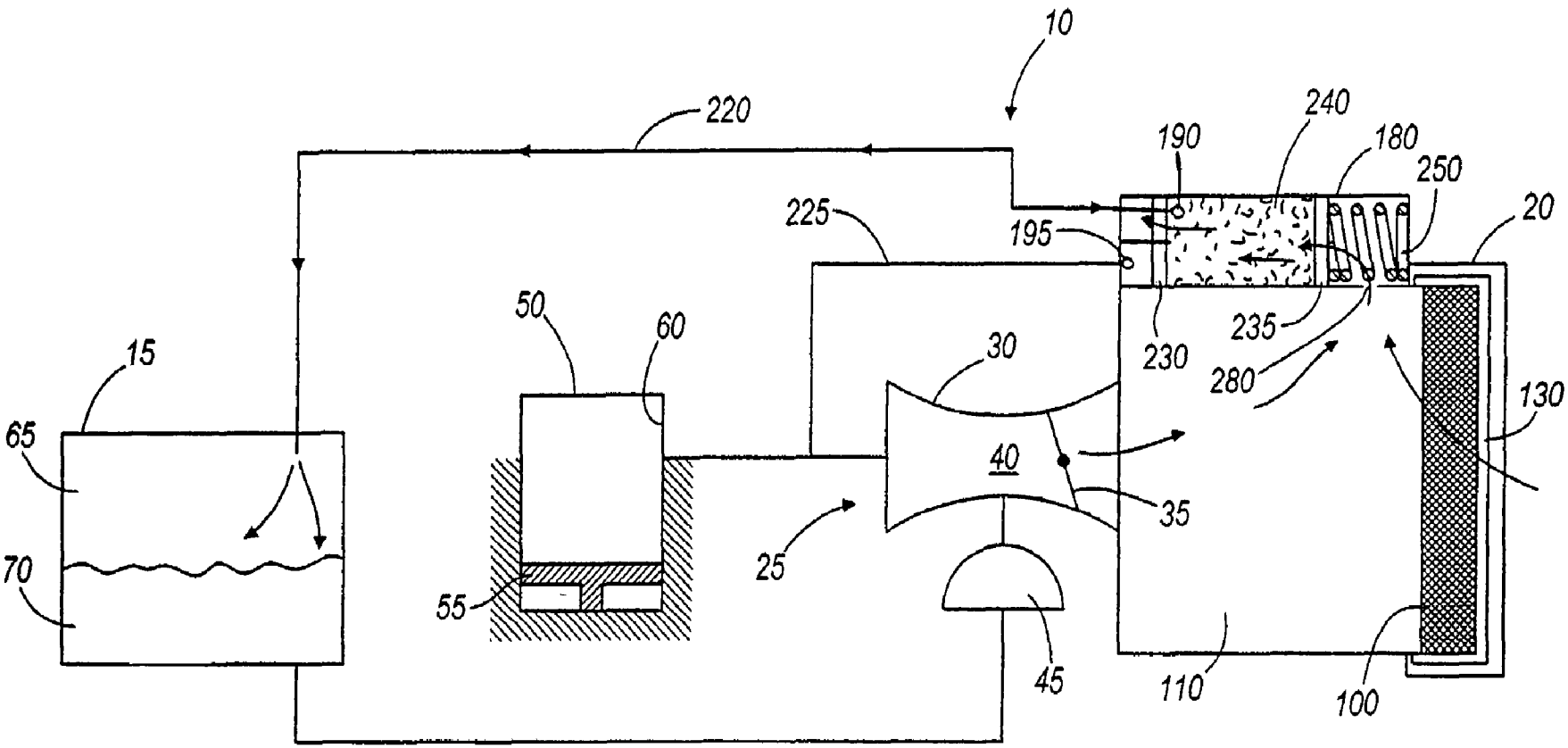
FIG. 8 is a schematic illustration of the vapor containment system during a pressure drop within the fuel tank.

FIG. 8 illustrates the engine 10 during a period in which the pressure within the fuel tank 15 has dropped below atmospheric pressure and the engine 10 is not running. As with an increase in pressure, this condition often occurs when an engine 10 is stored in an area that is subjected to fluctuating temperatures. As the temperature drops, the pressure within the tank 15 drops. To equalize the pressure within the tank 15, unfiltered air is drawn into the filter assembly 20 and through filter media 100 to the clean air space 110. From the clean air space 110, the air passes into the canister 180 via the filtered air path 280. The air passes through the canister 180 in a direction that is the reverse of that described with regard to FIG. 6. As the air passes through the filter media 240, it picks up some of the adsorbed fuel vapor, thus at least partially purging the filter media 240. The fuel vapor mixes with the air to produce an air-fuel mixture that flows along the first flow path 220 to the fuel tank 15.

Figure 9:
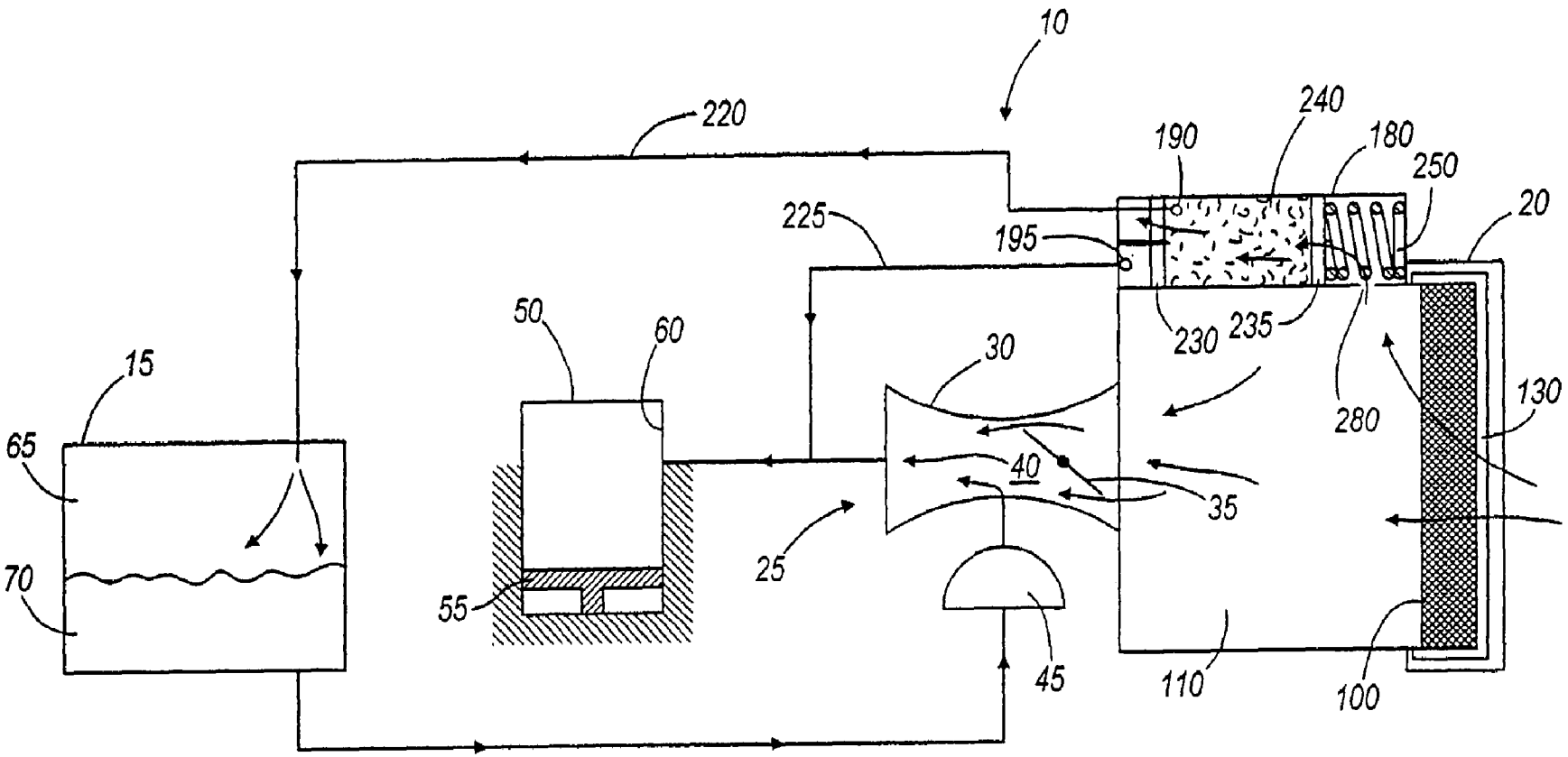
FIG. 9 is a schematic illustration of the vapor containment system during a pressure drop within the fuel tank when the engine is running.

FIG. 9 illustrates an operating condition in which the pressure within the fuel tank 15 has dropped relative to atmospheric pressure and the engine 10 is running. This condition occurs naturally as the fuel tank 15 is emptied during engine operation. This mode is similar to the mode illustrated in FIG. 8, except that liquid fuel 70 flows to the fuel bowl 45 of the carburetor 30. In addition, air drawn through the filter element 100 is pulled through the carburetor throat 40. The air flow through the carburetor throat 40 draws fuel into the air stream as was described with regard to FIG. 7. Air also flows through the filter element 100 and into the canister 180. The air flows along the second flow path 225 to purge the filter media 240 before also flowing into the air-fuel mixing device 25, as illustrated in FIG. 7.

Figure 10:
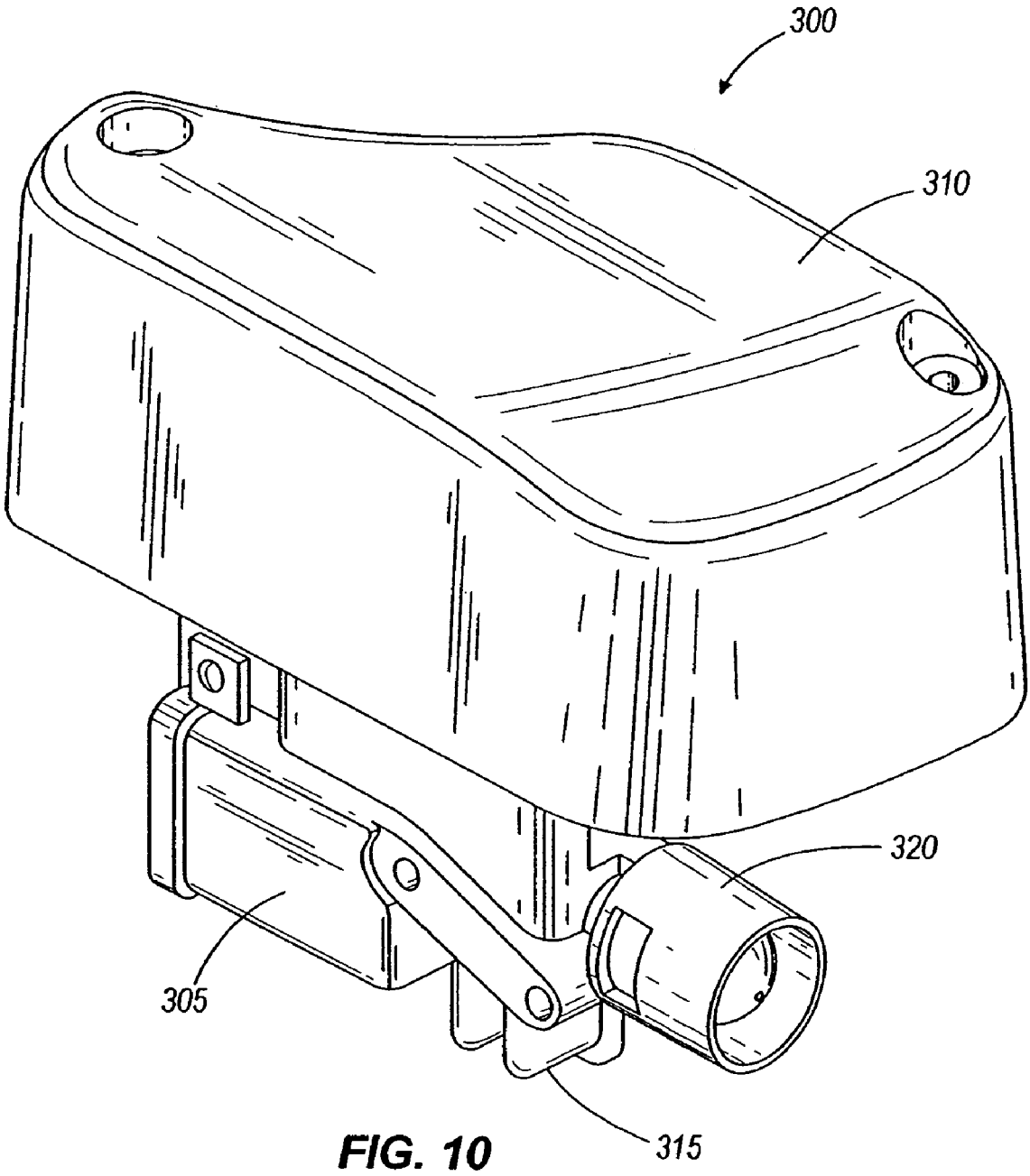
FIG. 10 is a perspective view of another air cleaner assembly embodying the invention.
Figure 11:
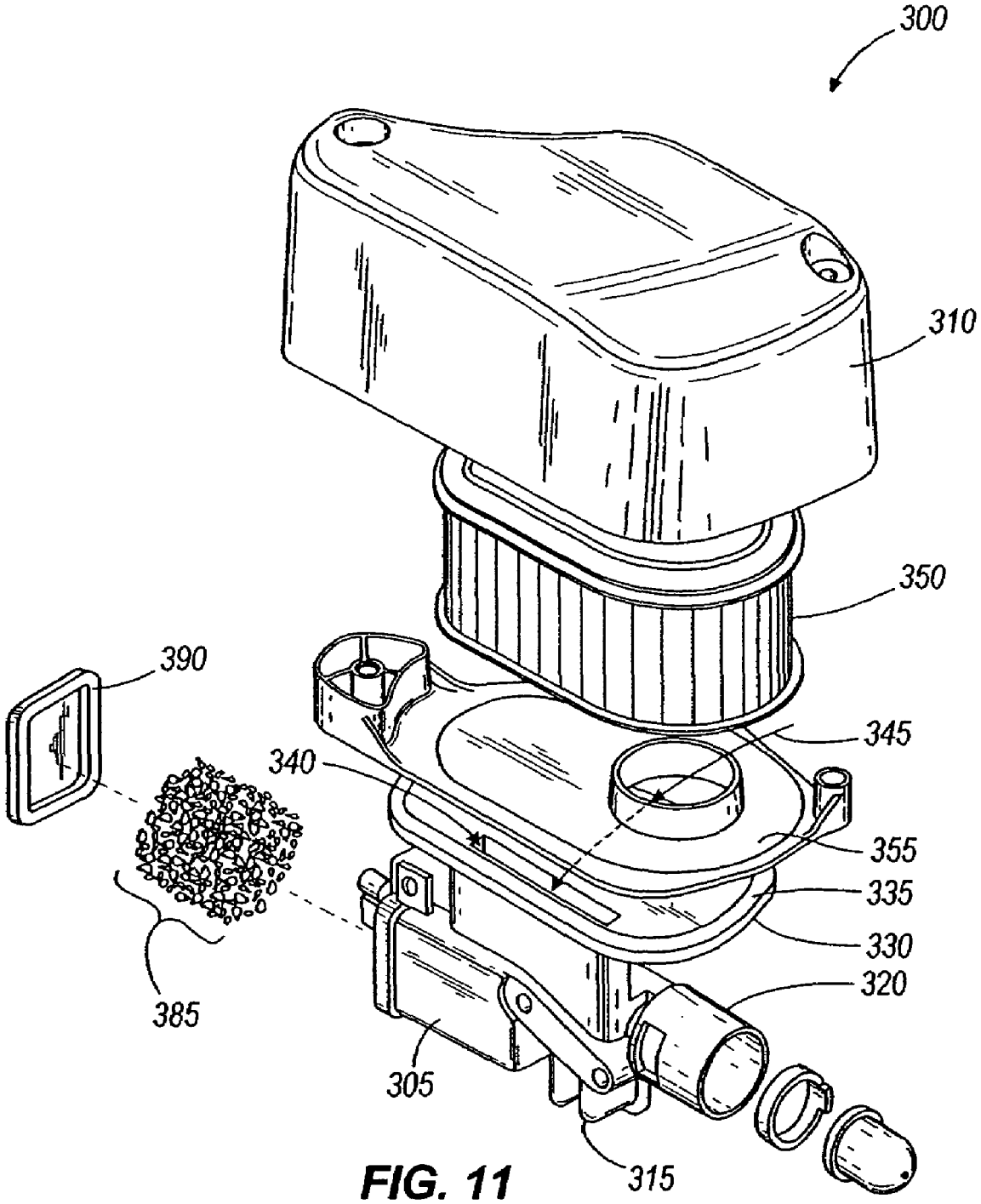
FIG. 11 is an exploded perspective view of the air cleaner assembly of FIG. 10.
Figure 12:
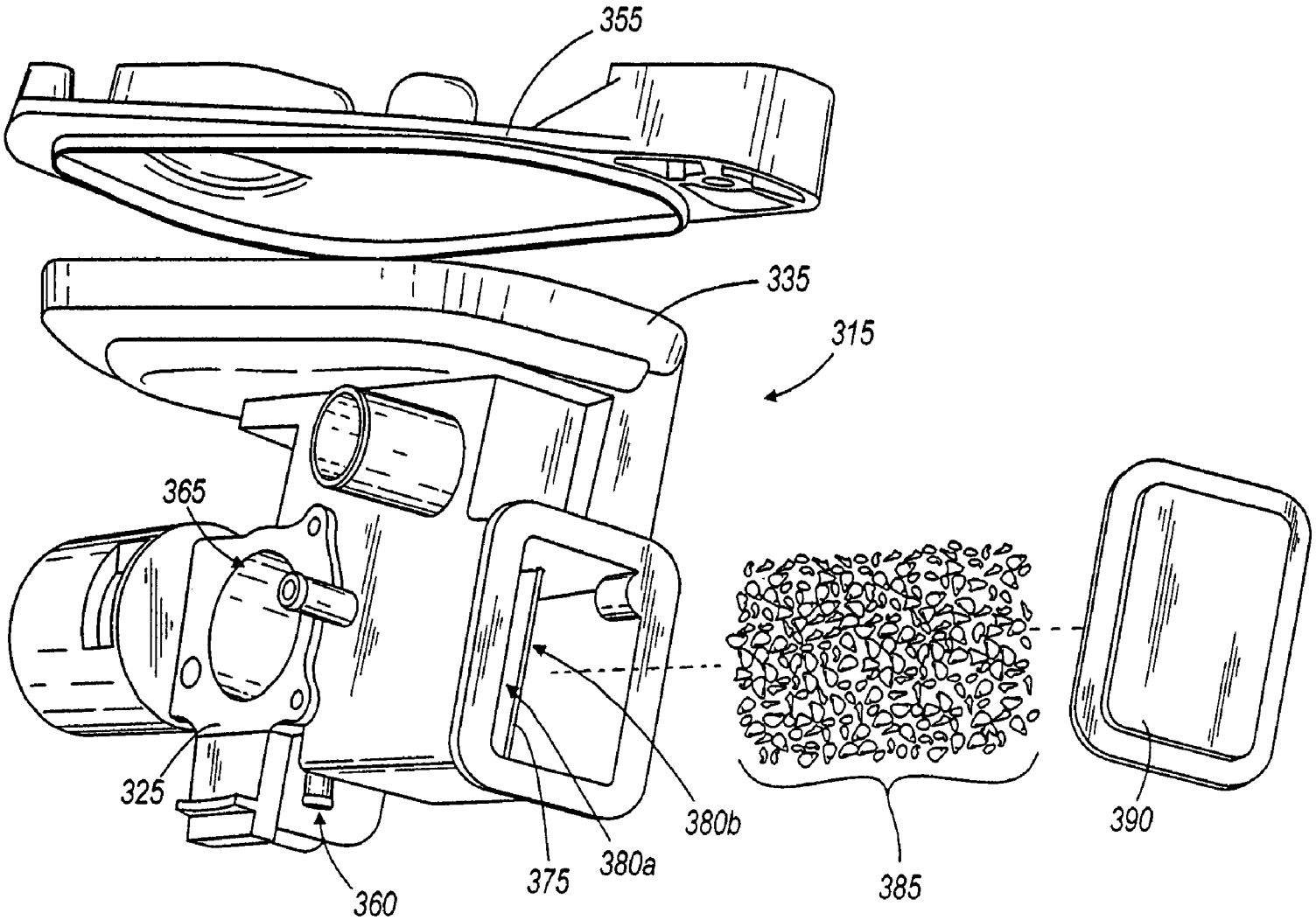
FIG. 12 is an enlarged exploded perspective view of a portion of the air cleaner assembly of FIG. 10.

It should be understood that many air cleaner arrangements incorporating a filter canister are possible. For example, FIGS. 10-12 illustrate another air cleaner assembly 300 that includes a canister 305. The air cleaner assembly 300, shown exploded in FIG. 11, also includes a cover 310 that is contoured to match or complement the engine or device to which the assembly 300 attaches. A filter base 315 attaches to the engine and at least partially defines a primer housing 320, an attachment flange 325, a top flange 330, and the canister 305. The primer housing 320 is similar to the primer housing 165 described with regard to FIGS. 2 and 3. The attachment flange 325 is also similar to the attachment flange 160 described with regard to FIGS. 2 and 3. The attachment flange 325 is adapted to receive a portion of an air-fuel mixing device, such as a carburetor 30 (as shown in FIG. 2). The top flange 330 includes a substantially flat structure 335 that defines an aperture 340 (shown in FIG. 11) that provides a portion of a first flow path 345 that extends between a filter element 350 and the attachment flange 325. The top flange 330 also supports an intermediate flange 355 which engages and supports the filter element 350. The cover 310 attaches to the intermediate flange 355 using fasteners, or any other suitable attachment means.

The canister 305, illustrated in FIG. 12, includes a second flow path 360 that provides fluid communication between the fuel tank and the canister 305 and a third flow path 365 that provides fluid communication between the canister 305 and the fuel-air mixing device as well as the first flow path 345 that is at least partially formed as part of the filter base 315 and provides fluid communication between a clean air space 370 and the canister 305. The three flow paths 345, 360, 365 are similar to those described with regard to the construction of FIGS. 2-5.

The position and orientation of the canister 305 requires that it be shorter than the canister 180 of FIGS. 2-5. To assure sufficient filtration, the canister 305 includes a central wall 375 that splits the canister into two flow legs 380*a*, 380*b*. Flow between the second flow path 360 and the first flow path 345 must pass through both legs 380*a*, 380*b* of the canister 305, thus assuring adequate filtration. Carbon filter media 385 is disposed within both legs 380*a*, 380*b* of the canister 305 to provide for the adsorption and de-adsorption of fuel vapor. A cover 390 fits over the open end of the canister 305 and can be permanently affixed (e.g., welded, glued, etc.) or can be removably attached (e.g., fasteners, etc.). If removably attached, the user could access the carbon filter media 385 and replace it if desired.

The function of the air cleaner assembly 300 is much the same as the function of the air cleaner assembly 20 illustrated in FIGS. 1-6. In fact, the description of the function, as well as the illustrations contained in FIGS. 7-9, are equally applicable to the air cleaner assembly 300 of FIGS. 10-12.

Thus, the invention provides, among other things, a new and useful vapor containment system for an engine 10. More particularly, the invention provides a new and useful vapor containment system for an engine 10 that is at least partially formed as part of an engine air cleaner assembly 20. Various features and advantages of the invention are set forth in the following claims.

What is claimed is:

1. An air cleaner for an engine, the engine including a fuel tank and an air-fuel mixing device, the air cleaner comprising:

a housing defining an internal filter space;

a canister at least partially formed as part of the housing, the canister being substantially non-permeable to fuel vapor;

a first aperture configured to provide fluid communication between the fuel tank and the canister;

a second aperture configured to provide fluid communication between the canister and the air-fuel mixing device;

a wall configured to define a portion of the housing and a portion of the canister; and a third aperture extending through the wall and configured to provide fluid communication between the internal filter space and the canister.

2. The air cleaner of claim 1, further comprising a filter element disposed substantially within the internal filter space and operable to provide a clean air space.

3. The air cleaner of claim 1, wherein the canister defines a first end and a second end, and wherein the third aperture is disposed near the first end, and wherein the first aperture and the second aperture are located near the second end.

4. The air cleaner of claim 1, wherein the canister includes a canister space that is at least partially filled with a filter media.

5. The air cleaner of claim 4, wherein the filter media includes a hydrocarbon adsorbent substance.

6. The air cleaner of claim 4, further comprising a biasing member positioned to bias the filter media toward the first aperture.

7. An air cleaner for an engine, the engine including a fuel tank and an air-fuel mixing device, the air cleaner comprising:

a housing configured to be attached to the engine;

a filter element supported by the housing and positioned to define a clean air space;

a canister integral with the housing and including a wall that defines a portion of the housing and includes an aperture that provides fluid communication between the clean air space and the canister;

a first passageway configured to provide fluid communication between the canister and the air-fuel mixing device; and a second passageway configured to provide fluid communication between the canister and the fuel tank.

8. The air cleaner of claim 7, wherein the canister is at least partially formed as part of the housing.

9. The air cleaner of claim 7, wherein the canister is substantially non-permeable to fuel vapor.

10. The air cleaner of claim 7, wherein the canister defines a first end and a second end and wherein the aperture is disposed near the first end and the first passageway and the second passageway are located near the second end.

11. The air cleaner of claim 7, wherein the canister includes a canister space that is at least partially filled with a filter media.

12. The air cleaner of claim 11, wherein the filter media includes a hydrocarbon adsorbent substance.

13. The air cleaner of claim 11, further comprising a biasing member positioned to bias the filter media toward the second passageway.

14. An engine comprising:

a combustion chamber operable to combust an air-fuel mixture;

an air-fuel mixing device operable to deliver the air-fuel mixture to the combustion chamber;

a fuel tank;

an air cleaner including a housing that defines a clean air space;

a canister at least partially formed as part of the housing and including a wall that defines a portion of the canister and a portion of the housing and includes an aperture that provides fluid communication between the canister and the clean air space;

a first passageway configured to provide fluid communication between the canister and the air-fuel mixing device; and a second passageway configured to provide fluid communication between the canister and the fuel tank.

15. The engine of claim 14, wherein the air cleaner assembly includes a filter element positioned to define the clean air space.

16. The engine of claim 14, wherein the canister is substantially non-permeable to fuel vapor.

17. The engine of claim 14, wherein the canister includes a canister space that is at least partially filled with a filter media.

18. The engine of claim 17, wherein the filter media includes a hydrocarbon adsorbent substance.

19. The engine of claim 17, wherein the canister includes a first passageway aperture that provides fluid communication between the canister space and the first passageway and a second passageway aperture that provides fluid communication between the canister space and the second passageway.

20. The engine of claim 19, further comprising a biasing member positioned to bias the filter media toward the first passageway aperture.

21. The air cleaner of claim 1, wherein the third aperture is a single opening between the internal filter space and the canister, and wherein all of the flow between the internal filter space and the canister passes through the single opening.

22. The air cleaner of claim 1, wherein the canister includes at least one outer wall, and the first aperture is positioned away from the outer wall.

23. The air cleaner of claim 7, wherein the aperture is a single opening between the clean air space and the canister, and wherein all of the flow between the clean air space and the canister passes through the single opening.

24. The air cleaner of claim 7, wherein the canister includes at least one outer wall, and the first aperture is positioned away from the outer wall.

25. The engine of claim 14, wherein the aperture is a single opening between the clean air space and the canister, and wherein all of the flow between the clean air space and the canister passes through the single opening.

26. The air cleaner of claim 14, wherein the canister includes at least one outer wall, and the first aperture is positioned away from the outer wall.

* * * * *